United States Patent [19]

Stefanye

[11] Patent Number: 4,993,324

[45] Date of Patent: Feb. 19, 1991

[54] RETAINER FOR GRENADE BODY LOADING ASSEMBLIES FOR DEMOLITION OF UNEXPLODED ORDANCE

[75] Inventor: David Stefanye, Potomac, Md.

[73] Assignee: The United States of America as represented by the Secretary of the Army, Washington, D.C.

[21] Appl. No.: 407,385

[22] Filed: Sep. 6, 1989

[51] Int. Cl.[5] ..... C06C 5/06

[52] U.S. Cl. ..... 102/275.12; 102/321

[58] Field of Search ..... 102/275.12, 275.7, 275.5, 102/318, 321, 344, 349, 358

[56] References Cited

U.S. PATENT DOCUMENTS

| | | | |
|---|---|---|---|
| H136 | 10/1986 | Field | 102/487 |
| H251 | 4/1987 | Field | 102/487 |
| 494,438 | 3/1893 | Pierce | 102/344 |
| 2,377,763 | 6/1945 | Darnell | 102/321 |
| 2,799,224 | 7/1957 | Long | 102/321 |
| 3,048,103 | 8/1962 | Blair, Jr. et al. | 102/318 |
| 4,495,867 | 1/1985 | Mitchell, Jr. et al. | 102/275.7 |
| 4,722,279 | 2/1988 | Yunan | 102/275.7 |
| 4,815,382 | 3/1989 | Yunan | 102/275.7 |
| 4,852,496 | 8/1989 | Campagnuolo et al. | 102/322 |

FOREIGN PATENT DOCUMENTS

| | | | |
|---|---|---|---|
| 668932 | 6/1979 | U.S.S.R. | 102/275.7 |
| 13890 | of 1909 | United Kingdom | 102/275.12 |
| 2112507 | 7/1983 | United Kingdom | 102/275.12 |

*Primary Examiner*—Charles T. Jordan
*Assistant Examiner*—Stephen Johnson
*Attorney, Agent, or Firm*—Anthony T. Lane; Milton W. Lee; Charles D. Miller

[57] ABSTRACT

A retainer for retaining a body loading assembly of a U.S. Army M42 or M46 general purpose grenade in firm intimate contact with at least one detonating cord, or an electric or non-electric blasting cap for use in explosive demolition of unexploded ordnance designated for disposal. The inner diameter of the retainer is nominally the same as the outer diameter of the body loading assembly with retention achieved by friction after insertion of a grenade body into the retainer. Holes in the wall of the retainer allow insertion and retention of one or two segments of detonating cord, or of an electric or non-electric blasting cap against the primer lead cup of the grenade body loading assembly for reliable initiation. The retaining clip may be configured as a short right cylinder with or without an attached spline, or as a truncated right cylinder, these configurations permit placement of the assembly squarely on the ordinance, or when in stacked or truncated configurations, permit insertion of the pointed portion into the ground or between individual items of ordnance for aiming the grenade to maximize an explosive effect.

9 Claims, 3 Drawing Sheets

RETAINER FOR GRENADE BODY LOADING ASSEMBLIES FOR DEMOLITION OF UNEXPLODED ORDANCE

STATEMENT OF GOVERNMENT INTEREST

The invention described herein may be manufactured and used by or for the United States Government for governmental purposes without payment of any royalties therefor or thereon.

BACKGROUND OF THE INVENTION

This invention relates to retainers for grenade body loading assemblies used for explosive demolition of unexploded ordnance designated for disposal, and more particularly, to retainer clips for retaining and positioning a U.S. Army M42 or M46 general purpose grenade body loading assembly relative to a detonating cord, electric or non-electric blasting caps for exploding desired explosives.

PRIOR ART

Requirements for disposal of unexploded ordnance such as dud projectiles encountered in impact areas or landmines remaining in minefields after cessation of hostilities have emphasized explosive demolition. This is due to the sensitivity of the ordnance item due to improperly functioned fusing, to partially deteriorated fuse components, or in the case of landmines, to the likelihood of the presence of antilift or antidisturbance devices or influence fusing. In practice, demolitionists dispose of these items in situ using prior art bulk explosives such as Composition C-4, plastic bonded or other moldable explosives. Cost analysis of large scale explosive disposal operations has shown that use of such bulk explosives, while effective, is expensive and time-consuming. This has stimulated a search for cheaper explosive ordnance disposal procedures and materials. A holder has been developed in parallel herewith in which a mild steel clip retains the U.S. Army M42 or M46 general purpose grenade body loading assembly, which costs a fraction of the amount of C-4 explosives normally used for a single detonation, which is an efficient ordnance disposal device. Either the M42 or the M46 pattern features a body loading assembly fitted with a shaped charge cone, a lead cup primer and two protruding rivets at each side of the primer cup. These loading assemblies contain 31 grams of A-5 explosive fill. The sole difference between the two explosive patterns consists of an embossing on the interior of the M46 body to provide fragmentation greater than that produced by the M42. The above mentioned developed holder includes a metallic clip with two wings for retention of the M42 or M46 body loading assembly and its primer in contact with a firing device such as a length of detonating cord, or an electric or non-electric blasting cap. This configuration is deficient in that retention of a cap or length of detonating cord against the lead primer depends upon the integrity of a spring tension of the wings of the device pressing against the body loading assembly wall. Tests have indicated that insufficient holding pressure often is not provided which causes the firing device to fall out or pull away from its contact with the lead cup primer, thereby producing a misfire.

A second consideration in the case of using a mild steel clip is the cost of their fabrication. While a clip consists of a piece of stamped and formed inexpensive sheet of mild sheet steel, the principal cost factor stems from an expensive die required for stamping and the availability of a suitable stamping press. This factor precludes small quantity production at reasonable unit cost.

In view of the aforementioned deficiencies, there is a need for an inexpensive retainer for grenade body loading assemblies that, in addition, will provide reliable and robust retention of firing train components.

SUMMARY OF THE INVENTION

In view of the aforementioned considerations, it is a feature of the present invention to provide new and improved assemblies for retaining grenade loading body assemblies and firing devices such as electric or non-electric blasting caps or detonating cord in close, firm contact for purposes of explosive demolition of unexploded ordnance designated for disposal.

In view of this feature, the present invention contemplates a thin walled right cylinder, preferably of commercial polyvinylchloride pipe, with one or more pairs of aligned holes punched in the wall at either end to receive a non-electric or electric blasting cap or a length of detonating cord. The cylinder has an inner diameter equal to that of the outer diameter of the grenade body loading assembly and is capable of receiving and or retaining the grenade body loading assembly by friction firmly against the firing component (cap or detonating cord). The firing components are thus placed in intimate and firm contact with the lead cup primer of the grenade body loading assembly and retained within the holder to ensure reliable detonation.

The present invention further includes the concept of an acutely-truncated right cylinder or of a right cylinder with a pointed spline attached to or formed as an integral part of the outer wall to provide a configuration that enables placement of a grenade body loading assembly and retainer relative to the ground or between items of unexploded ordnance to assure firm positioning and aiming, or appropriate stand off of the assembly at the ordnance target.

DESCRIPTION OF THE PREFERRED EMBODIMENT

Figure 1:
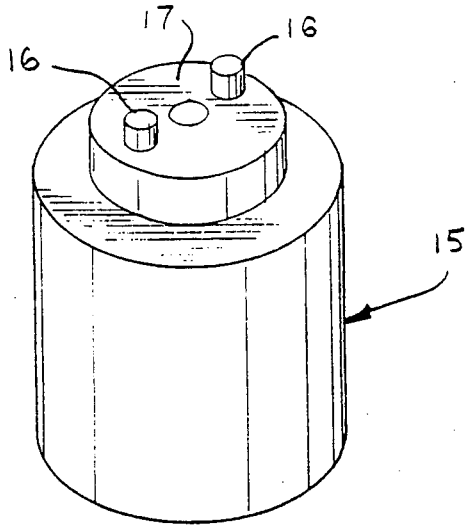
FIG. 1 is a perspective view of the body loading assembly of a general purpose grenade, M42 or M46.

Referring now to FIG. 1, there is shown a body loading assembly of a general purpose grenade M42 or M46, generally designated by the numeral 15, which features two rivets 16 for fuse attachment and a lead cup primer 17. The M42 or M46 grenade contain 31 grams of Composition A5 explosive and a copper cone shaped charge, and have the same diameter (1.25 inches) and length (2.25 inches exclusive of rivets). The principal difference between the M42 or M46 variant is that the latter has a scored interior wall for greater fragment production.

Figure 2:
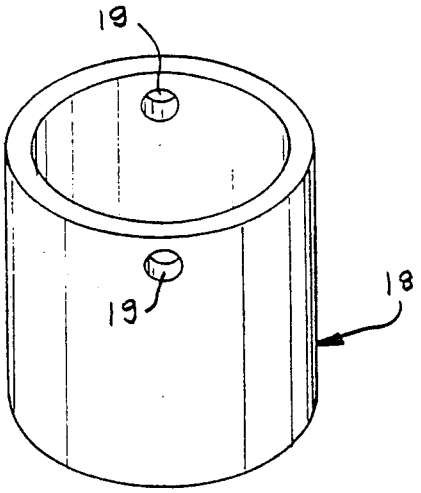
FIG. 2 is a perspective view of a cylindrical body loading assembly retainer with one pair of holes to accommodate a firing device.

Referring now to FIG. 2, there is shown a segment of polyvinyl chloride (PVC) pipe 18, made in a standard thermoplastic pipe dimension ratio and of nominal interior diameter 1.25 inches and average outside diameter 1.660 inches. This pipe segment, herein referred to as a body loading assembly retainer 18 features one or two offset pairs of aligned holes 19, 20. These are punched near one end and of sufficient diameter to insert a standard U.S. M6 electric blasting cap (0.24 inch diameter) or a length of U.S. Type I class E standard detonating cord (0.235 inch diameter).

Figure 3:
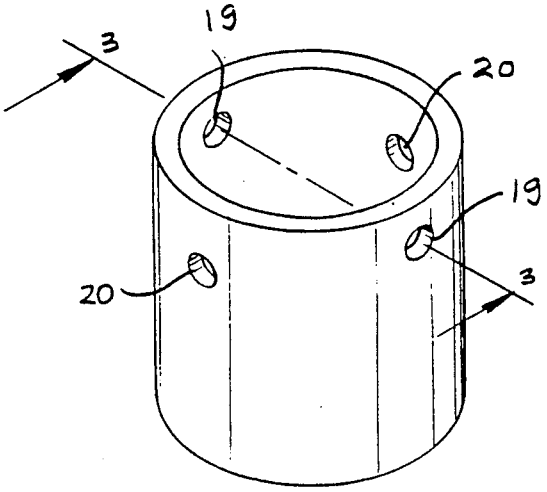
FIG. 3 is a perspective view of a cylindrical body loading assembly retainer with two pair of holes to accommodate a firing device.
Figure 4:
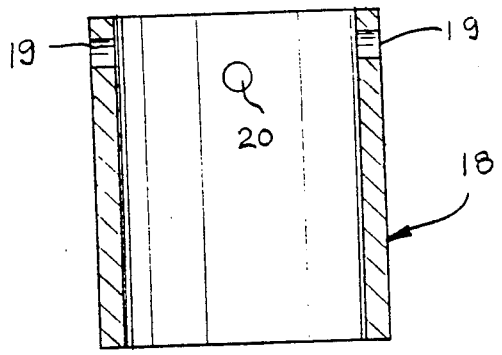
FIG. 4 is a cross sectional view along line 3—3 of FIG. 3, showing the relationship of holes for the firing devices.
Figure 5:
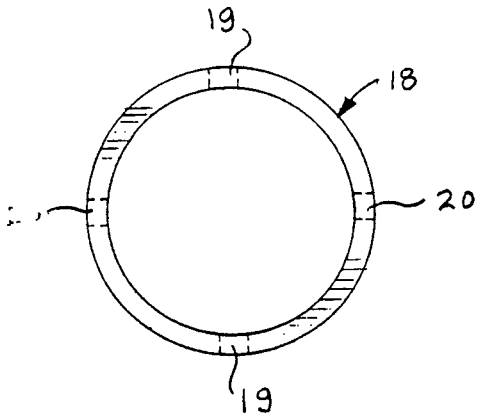
FIG. 5 is an end view, partially in broken or phantom line, of FIG. 3.
Figure 6:
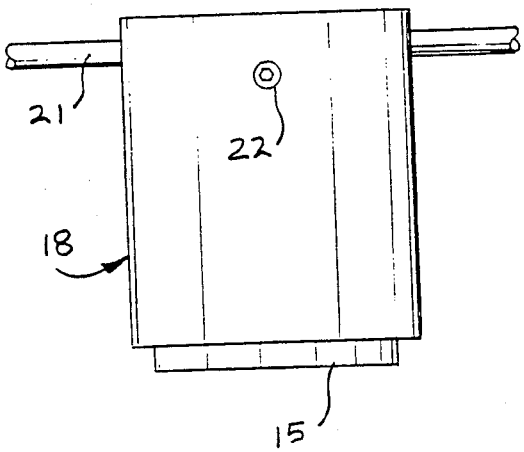
FIG. 6 is a side view of a body loading assembly retainer with two pair of holes and containing a body loading assembly and a strand of detonating cord.
Figure 7:
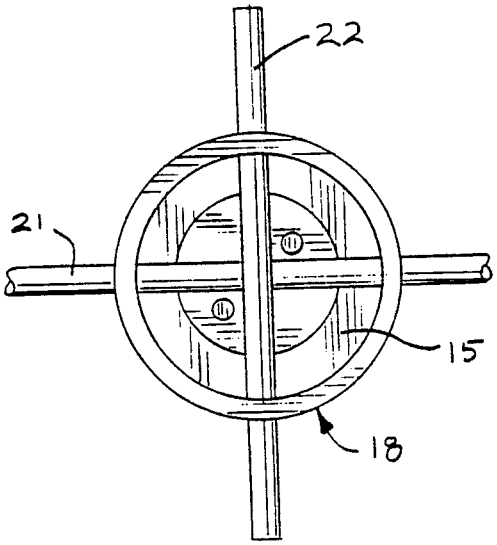
FIG. 7 is a top view of FIG. 6 showing cross-over of detonating cord for reliable firing.

Referring now to FIG. 3, high reliability firing may be achieved by punching an additional pair of aligned holes 20 into the body loading retainer wall. FIG. 4 shows the relationship of the first pair 19 and second pair of holes 20, the latter being punched one hole diameter below the former. FIG. 4 shows the angular offset of ninety degrees between the first pair of holes 19 and the second pair of holes 20. In practice, the cap or detonating cord, herein referred to as the firing device, is inserted through the holes, and a body loading assembly is pushed into the retainer until lead primer 17 makes contact with the firing device 21. FIG. 7 shows an end view of a body loading assembly in a body loading assembly retainer rigged with the lengths of detonating cord used as firing devices. The body loading assembly is rotated to position its rivets 16 to preclude interference with the contact of the principal firing device 21 with the lead cup primer 17. The secondary firing device 22 is a six-inch length of detonating cord. When rigged in this fashion the body loading assembly presses against the cords 21 and 22 which are prevented from moving by the body loading assembly retainer wall.

Figure 8:
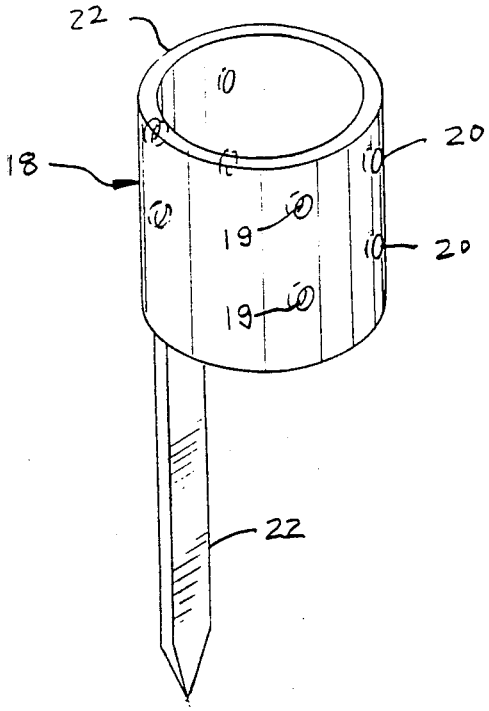
FIG. 8 is a perspective view of a body loading assembly retainer with two pair of holes for firing devices and a spline attached, used for insertion and downward firing of the body loading assembly.
Figure 9:
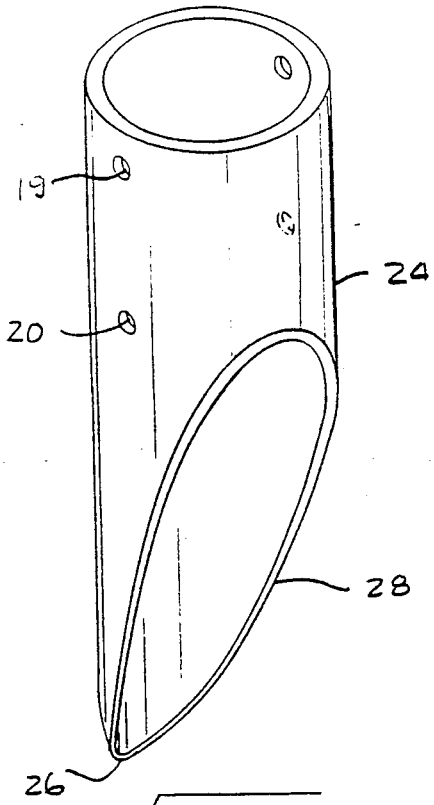
FIG. 9 is a perspective view of a body loading assembly retainer with two pairs of holes for firing devices and a spline attached, used for insertion and upward firing of the body loading assembly.

It is a feature of this invention to enable aiming and firing the body loading assembly in either an upward or downward direction for the convenience of the demolitionist. Referring now to FIGS. 8 and 9, the body loading assembly retainer 18 may be attached to a stake or spline 22 made as an integral part or a separate piece of like material to provide a staked assembly for insertion of the spline into the ground or between individual items of unexploded ordnance to be disposed. In practice attachment of the spline of like material is achieved by application of tetrahydrofuran and cyclohexanone-based cement for polyvinylchloride pipe. Aiming for downward firing of the body leading assembly is achieved by attaching the retainer 18 with hole pairs 19, 20 oriented away from the sharp end of the spline. The spline is made from a piece of pipe having the same curvature as the retainer body with the unsecured end cut to form a sharp point. The portion of the spline secured to the retainer body may be approximately one sixth the circumference of the retainer body and from three to four times the body length. Aiming for upward firing is achieved by attaching retainer 18 with hole pairs 19, 20 oriented towards the sharp end of spline 22. In each case, the body loading assembly is inserted into the body of the staked retainer so as to allow contact of the firing device with the lead cup primer. The configuration shown in FIG. 8 permits placement of the body loading assembly and retainer squarely on the ordnance to be disposed because one end of the spline is cut flush with the retainer.

Figure 10:
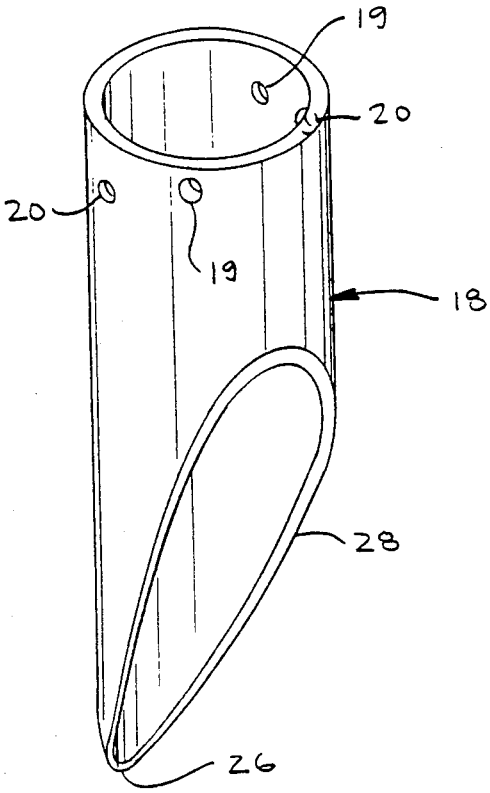
FIG. 10 is a perspective view of a truncated body loading assembly retainer with pointed end and two pair of holes for downward aiming and firing of the body loading assembly.
Figure 11:
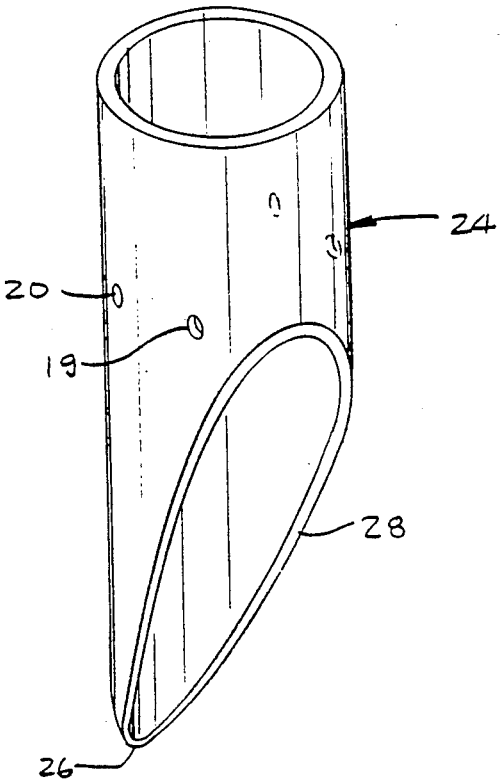
FIG. 11 is a perspective view of a truncated body loading assembly retainer with pointed end and two pair of holes for upward aiming and firing of a body loading assembly.

It is an additional feature of the instant invention to provide configurations for aiming and firing body loading assemblies using retainers of simple design, capable of fabrication on-site by the demolitionist with simple hand tools such as a hand-punch, saw and miter box. FIG. 9, 10 and 11, illustrate elongated body loading assembly retainers 24 with truncated sharp ends 26 capable of being manufactured in this fashion to provide a sharpened end for purposes of inserting the sharp end into the ground and for aiming and firing the body loading assembly in an upward or downward direction as previously described. In this instance the retainer is fabricated of one piece of pipe with pairs of holes 19, 20 situated at the top or at the midpoint respectively to allow firing in the downward or upward directions, and the pipe is cut at an angle 28 of approximately fifteen to twenty degrees to form the sharp end.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A retainer for retaining a detonating means and a body loading assembly of a general purpose grenade in firm, intimate contact for using said grenade for demolition purposes, said retainer comprising:

a cylindrical body formed of a composite material with an interior diameter equal to an exterior diameter of said body loading assembly, said cylindrical body being capable of receiving and retaining said body loading assembly by friction;

one pair of oppositely disposed holes near an end of said retainer for accepting and retaining said detonating means, a second pair of oppositely disposed holes with said second pair of holes at least one hole diameter below and at right angles to said first pair of holes to accept and retain said detonating means to provide coverage of a lead cup primer of said body loading assembly by more than one detonating component to ensure high-reliability functioning.

2. A retainer as defined by claim 1, in which said detonating means comprises a length of detonating cord.

3. A retainer as defined by claim 1, in which the length of said retainer body for retaining the grenade and firing components is approximately equal to the length of said body loading assembly and is cut flush at each end.

4. A retainer as defined by claim 3, wherein a pointed spline extends from one end of said retainer body.

5. A retainer as defined by claim 3, wherein said spline is a separate piece and has a width one sixth of the circumference and a length three to four times the length of said retainer body, and said spline is attached to the outer wall of the retainer body to allow inserting the spline into the ground for aiming the grenade selectively downwards or upwards.

6. A retainer as defined by claim 1, in which the length of said retainer body for retaining the grenade and firing components is approximately equal to the length of said body loading assembly and is cut flush at each end.

7. A retainer as defined by claim 1, in which said one pair of oppositely disposed holes for retaining said detonating means is in a upper end portion of said cylindrical body.

8. A retainer as defined by claim 1, in which said one pair of oppositely disposed holes for retaining said detonating means is in a bottom end portion of said cylindrical body.

9. A retainer as defined by claim 1, in which said cylindrical body includes a main body portion for retaining firing components including said body loading assembly wherein said cylindrical body is substantially four times the length of said body loading assembly with one end of said cylindrical body cut flush and the opposite end cut at an acute angle for purposes of inserting the cut acute angle end into the ground and aiming said body loading assembly.

* * * * *